US008525006B2

(12) United States Patent
Yamanouchi

(10) Patent No.: US 8,525,006 B2
(45) Date of Patent: Sep. 3, 2013

(54) INPUT DEVICE AND RECORDING MEDIUM WITH PROGRAM RECORDED THEREIN

(75) Inventor: Morio Yamanouchi, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 70 days.

(21) Appl. No.: 13/239,862

(22) Filed: Sep. 22, 2011

(65) Prior Publication Data

US 2012/0090448 A1 Apr. 19, 2012

(30) Foreign Application Priority Data

Oct. 14, 2010 (JP) ..... 2010-231055

(51) Int. Cl.
*G10F 1/08* (2006.01)

(52) U.S. Cl.
USPC ..... 84/104; 84/723; 84/743; 84/411 R; 84/422.1

(58) Field of Classification Search
None
See application file for complete search history.

(56) References Cited

U.S. PATENT DOCUMENTS 5,062,341 A * 11/1991 Reiling et al. ..... 84/702
5,290,964 A * 3/1994 Hiyoshi et al. ..... 84/600
6,150,947 A * 11/2000 Shima ..... 340/692
6,759,583 B2 * 7/2004 Mizuno et al. ..... 84/422.4
8,198,526 B2 * 6/2012 Izen et al. ..... 84/743
2004/0025666 A1 * 2/2004 Mizuno et al. ..... 84/422.4
2011/0290097 A1 * 12/2011 Takahashi et al. ..... 84/622
2011/0303076 A1 * 12/2011 Harada ..... 84/742
2012/0006181 A1 * 1/2012 Harada et al. ..... 84/600
2012/0090448 A1 * 4/2012 Yamanouchi ..... 84/723
2012/0111179 A1 * 5/2012 Yamanouchi ..... 84/723
2012/0152087 A1 * 6/2012 Sakazaki ..... 84/600
2012/0216667 A1 * 8/2012 Sakazaki ..... 84/725

FOREIGN PATENT DOCUMENTS

JP 06-075571 3/1994

* cited by examiner

*Primary Examiner* — Marlo Fletcher
(74) *Attorney, Agent, or Firm* — Turocy & Watson, LLP

(57) ABSTRACT

An input device including: a first operation detecting section which is provided on one stick and detects acceleration based on movement of the one stick; a second operation detecting section which is provided on an other stick and detects acceleration based on movement of the other stick; a first strike judging section which judges whether or not the one stick and the other stick have struck against one another, based on the acceleration detected by the first operation detecting section and the acceleration detected by the second operation detecting section; and an instructing section which instructs to produce a sound corresponding to striking of the one stick and the other stick against one another, when the first strike judging section judges that the one stick and the other stick have struck against one another.

6 Claims, 8 Drawing Sheets

INPUT DEVICE AND RECORDING MEDIUM WITH PROGRAM RECORDED THEREIN

CROSS-REFERENCE TO RELATED APPLICATION

This application is based upon and claims the benefit of priority from the prior Japanese Patent Application No. 2010-231055, filed Oct. 14, 2010, the entire contents of which is incorporated herein by reference.

BACKGROUND OF THE INVENTION

1. Field of the Invention

The present invention relates to an input device suitable for use in, for example, an electronic percussion instrument, and a recording medium with a program recorded therein.

2. Description of the Related Art

Conventionally, an input device is known that detects movement and thereby generates operation input. For example, Japanese Patent Application Laid-Open (Kokai) Publication No. 06-075571 discloses a stick (drumstick) provided with a piezoelectric gyro sensor that detects angular speed. When a user grips the stick and swings it downward or to the right, operation input is generated by which a snare drum sound or a cymbal sound is designated based on the downward component or the rightward component of sensor output (angular speed) from a sensor that has detected the movement, and its sound volume is designated based on the sensor output level.

However, in the configuration of a technique such as that disclosed in Japanese Patent Application Laid-Open (Kokai) Publication No. 06-075571 where operation input is generated merely by the detection of the movement of a stick, operation input corresponding to an actual drum performance, such as the cross stick technique in which sticks (drumsticks) are struck against one another to produce a sound, cannot be generated.

An object of the present invention is to provide an input device capable of generating operation input corresponding to an actual drum performance, and a recording medium with a program recorded therein.

SUMMARY OF THE INVENTION

In accordance with one aspect of the present invention, there is provided an input device comprising: a first operation detecting section which is provided on one stick and detects acceleration based on movement of the one stick; a second operation detecting section which is provided on an other stick and detects acceleration based on movement of the other stick; a first strike judging section which judges whether or not the one stick and the other stick have struck against one another, based on the acceleration detected by the first operation detecting section and the acceleration detected by the second operation detecting section; and an instructing section which instructs to produce a sound corresponding to striking of the one stick and the other stick against one another, when the first strike judging section judges that the one stick and the other stick have struck against one another.

In accordance with another aspect of the present invention, there is provided an input device comprising: a first operation detecting section which is provided on one stick and detects acceleration based on movement of the one stick; a second operation detecting section which is provided on an other stick and detects acceleration based on movement of the other stick; a note-ON operation judging section which judges whether or not a note-ON operation of the one stick or the other stick has been performed based on the acceleration detected by the first operation detecting section and the acceleration detected by the second operation detecting section; a first strike judging section which judges whether or not the one stick and the other stick have struck against one another, based on the acceleration detected by the first operation detecting section and the acceleration detected by the second operation detecting section; and an instructing section which instructs to produce a sound corresponding to striking of the one stick and the other stick against one another which differs from a sound that is produced by the note-ON operation, when the first strike judging section judges that the one stick and the other stick have struck against one another.

In accordance with another aspect of the present invention, there is provided a non-transitory computer-readable storage medium having stored thereon a program that is executable by a computer, the program being executable by the computer to perform functions comprising: first operation detection processing for detecting acceleration based on movement of one stick; second operation detection processing for detecting acceleration based on movement of an other stick; strike judgment processing for judging whether or not the one stick and the other stick have struck against one another, based on the acceleration detected by the first operation detection processing and the acceleration detected by the second operation detection processing; and instruction processing for instructing to produce a sound corresponding to striking of the one stick and the other stick against one another, when the one stick and the other stick are judged to have struck against one another by the strike judgment processing.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

The preferred embodiments of the present invention will hereinafter be described with reference to the drawings.

A. Structure

Figure 1:
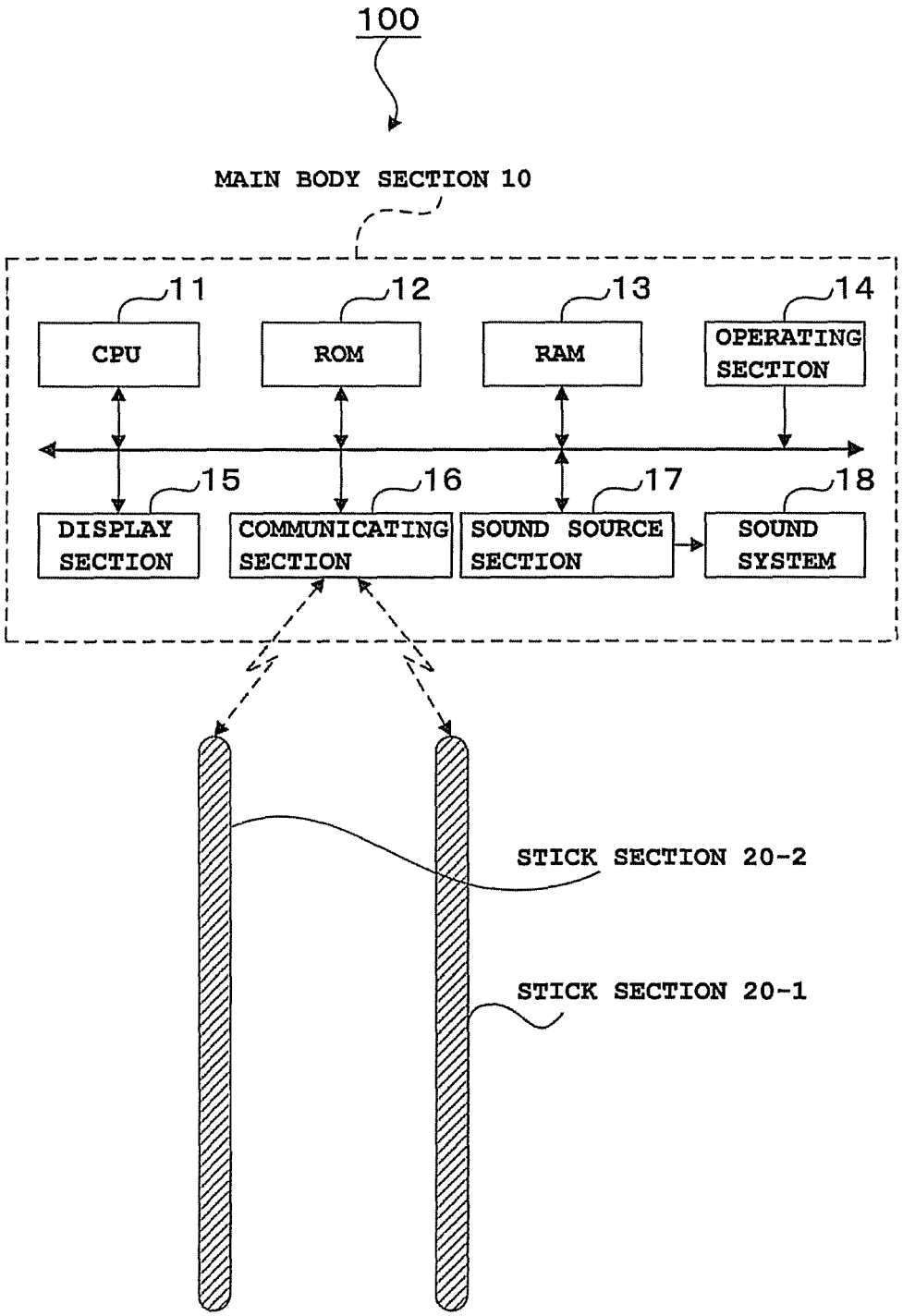
FIG. 1 is a block diagram showing the overall structure of an electronic percussion instrument 100 according to an embodiment.

FIG. 1 is a block diagram showing the overall structure of an electronic percussion instrument 100 including an input device according to an embodiment. The electronic percussion instrument 100 is broadly divided into a main body section 10, and stick sections 20-1 and 20-2 that are respectively gripped in the left and right hands of a user. The structure of the main body section 10 and the structure of the stick section 20 will hereinafter be described separately.

(1) Structure of Main Body Section 10

The main body section 10 includes a central processing unit (CPU) 11, a read-only memory (ROM) 12, a random access memory (RAM) 13, an operating section 14, a display section 15, a communicating section 16, a sound source section 17 and a sound system 18. The CPU 11 (a first strike judging section, an instructing section, a second strike judging section, a calculating section, an identifying section, and a note-ON operation judging section) actualizes functions of an input device that generates operation input corresponding to an actual drum performance by performing main body processing (see FIG. 4) described hereafter. Specifically, acceleration data wirelessly transmitted from each of the stick sections 20-1 and 20-2 is received, demodulated, and stored in the RAM 13, and when a series of stored acceleration data of the stick sections 20-1 and 20-2 establishes a predetermined relationship, the CPU 11 judges that the cross stick technique in which the sticks are struck against one another has been performed, and instructs the sound source section 17 to produce a unique sound (striking sound) generated by the cross stick technique.

The ROM 12 stores various program data, control data, and the like which are loaded by the CPU 11. The various programs here include the main body processing (see FIG. 4) described hereafter. The RAM 13 includes a work area and a data area. The work area of the RAM 13 temporarily stores various register and flag data used for processing by the CPU 11, and the data area of the RAM 13 stores acceleration data of the stick sections 20-1 and 20-2 received and demodulated via the communicating section 16 described hereafter. Note that identification data identifying whether acceleration data corresponds to the stick section 20-1 or the stick section 20-2 is added to each acceleration data stored in the data area of the RAM 13.

The operating section 14 includes a power switch for turning ON and OFF the power of the main body section 10, a play switch for giving an instruction to start or end a musical performance, and the like, and generates an event based on a switch operation. Events generated by the operating section 14 are received by the CPU 11. The display section 15 displays the operation status or the setting status of the main body section 10 based on display control signals supplied by the CPU 11.

The communicating section 16 receives acceleration data (including identification data) wirelessly transmitted from the stick sections 20-1 and 20-2 under the control of the CPU 11, and stores the received acceleration data in a predetermined area in the RAM 13. The sound source 17 is configured by the known waveform memory read-out method and replays waveform data of a musical sound (a percussion instrument sound or a striking sound) whose tone has been designated by the user, in accordance with a note-ON event supplied by the CPU 11. The sound system 18 converts the waveform data of a percussion instrument sound outputted from the sound source 17 to an analog signal format, and produces the sound from a speaker after removing unnecessary noise and amplifying the level.

(2) Structure of Stick Section 20

Figure 2:
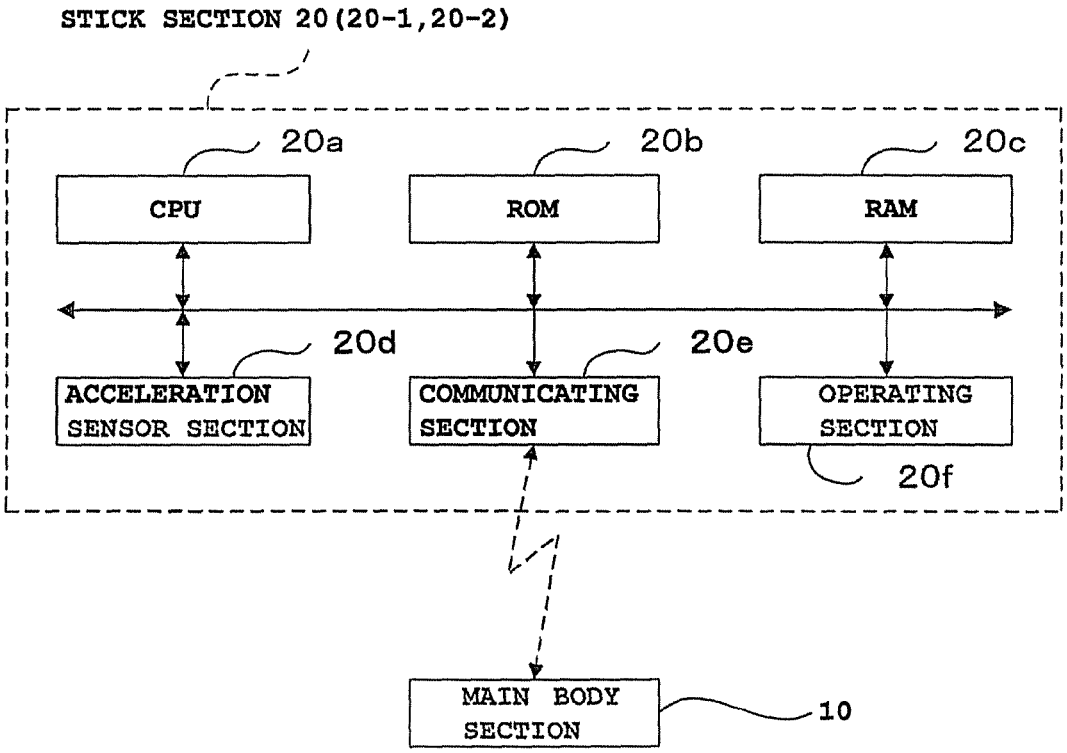
FIG. 2 is a block diagram showing the structure of a stick section 20.

Next, the structures of the stick sections 20-1 and 20-2 will be described with reference to FIG. 2. As shown in FIG. 2, the stick sections 20-1 and 20-2 each includes components **20*a* to 20*f* inside a stick that serves as its housing. A CPU 20*a* performs stick processing (see FIG. 3) described hereafter. In the stick processing, when the play switch is turned ON, the CPU 20*a* stores in a RAM 20*c* acceleration data generated by sampling output from an acceleration sensor section 20*d* (a first operation detecting section and a second operation detecting section), and after reading out the acceleration data stored in the RAM 20*c*, wirelessly transmits the acceleration data from a communicating section 20*e* to the main body section 10** side.

The ROM **20*b* stores various program data, control data, and the like which are loaded by the CPU 20*a*. The various programs here include the stick processing (see FIG. 3) described hereafter. The RAM 20*c* includes a work area and a data area. The work area of the RAM 20*c* temporarily stores various register and flag data used for processing by the CPU 20*a*, and the data area of the RAM 20*c* temporarily stores acceleration data generated by sampling output from the acceleration sensor section 20*d***.

The acceleration sensor section **20*d* is constituted by, for example, a capacitive-type acceleration sensor that detects acceleration of three orthogonal axis components, and an analog-to-digital (A/D) converting section that performs A/D conversion on output from the acceleration sensor and generates acceleration data. The communicating section 20*e* modulates acceleration data stored in the data area of the RAM 20*c* to data of a predetermined format, and wirelessly transmits the modulated acceleration data to the main body section 10 side. Note that identification data identifying whether acceleration data has been generated by the stick section 20-1 or the stick section 20-2 is added to each of wirelessly transmitted acceleration data. The operating section 20*f* includes a power switch for turning ON and OFF the power, a play switch for giving an instruction to start or end a musical performance, and the like, and generates an event based on a switch operation. Events generated by the operating section 20*f* are received by the CPU 20*a***.

B. Operations

Next, operations of the electronic percussion instrument 100 structured as above will be described with reference to FIG. 3 to FIG. 8. In the descriptions below, the operation of the stick processing performed by the CPU **20*a* on the stick 20 side and the operation of the main body processing performed by the CPU 11 on the main body section 10 side will be described as the operations of the electronic percussion instrument 100**.

(1) Operation of Stick Processing

Figure 3:
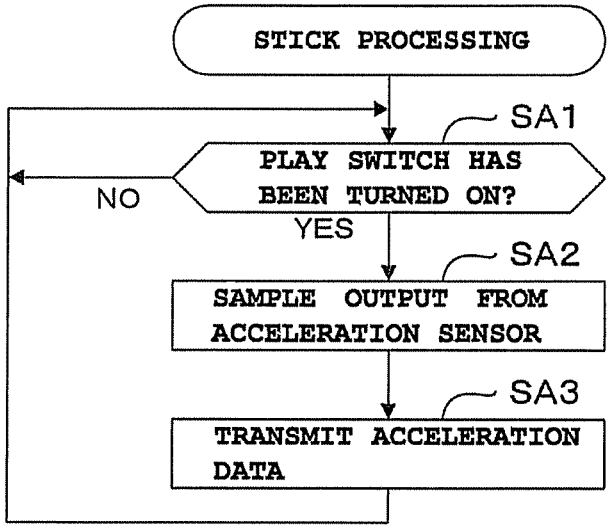
FIG. 3 is a flowchart of the operation of stick processing performed by the stick section 20.

When the stick section 20 is turned ON by the operation of the power switch, the CPU **20*a* performs the stick processing shown in FIG. 3 and proceeds to Step SA1. At Step SA1, the CPU 20*a* waits until the play switch is set in an ON state that indicates the start of a musical performance. When the user sets the play switch in the ON state, a judgment result at Step SA1 is "YES" and so the CPU 20*a* proceeds to Step SA2. At Step SA2, the CPU 20*a* stores acceleration data acquired by performing A/D conversion on output from the acceleration sensor section 20*d* in the RAM 20*c*. Next, at Step SA3, the CPU 20*a* adds identification data identifying whether the acceleration data has been generated by the stick section 20-1 or the stick section 20-2 to the acceleration data read out from the RAM 20*c*, and wirelessly transmits the acceleration data to the main body section 10 side from the communicating section 20*e***. Hereafter, until the play switch is set in an OFF state that indicates the end of a musical performance, the CPU

20*a* repeats Step SA1 to Step SA3 described above, and generates and wirelessly transmits acceleration data that changes depending on the stick operation performed by the user.

(2) Operation of Main Body Processing

Figure 4:
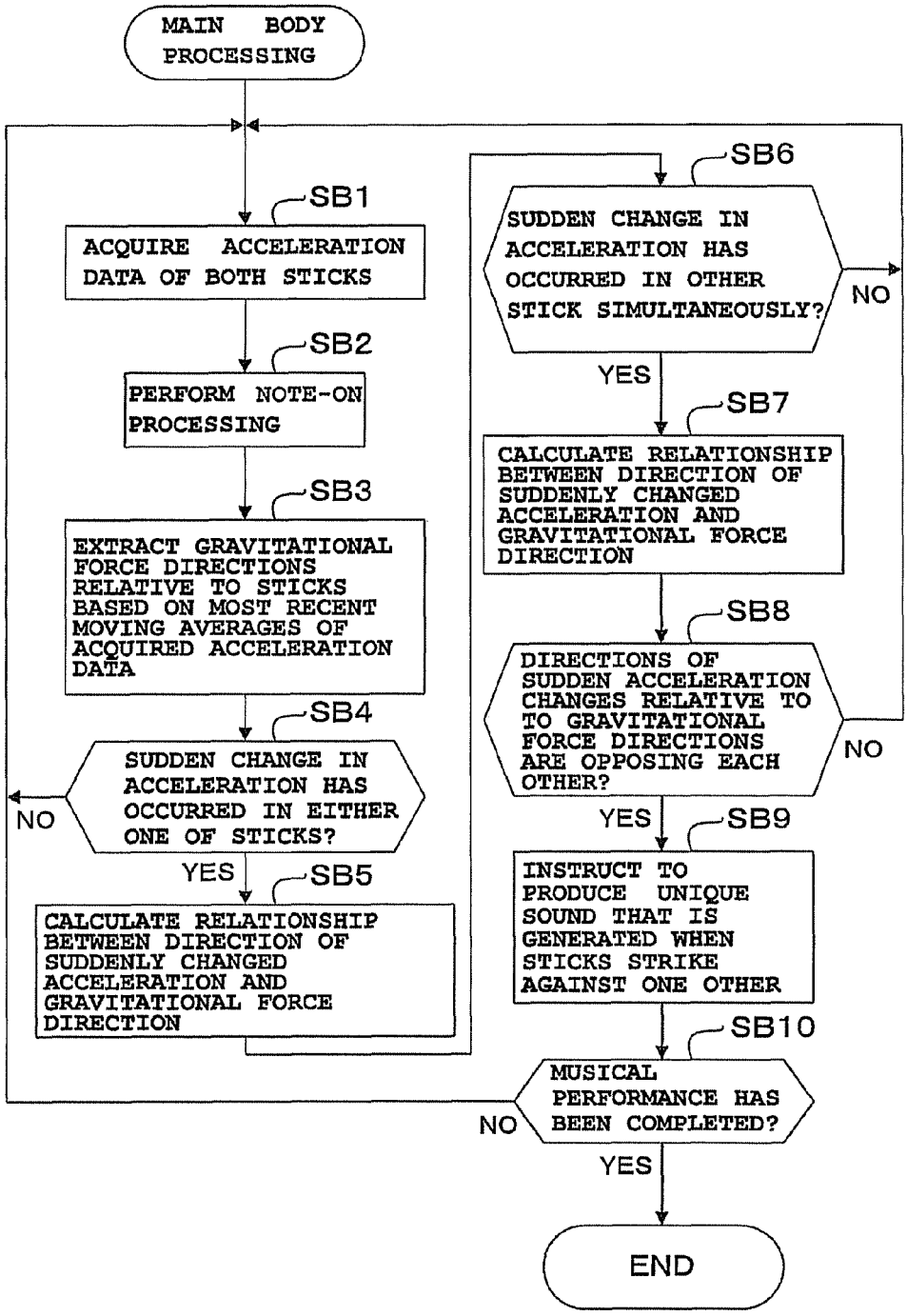
FIG. 4 is a flowchart of the operation of main body processing performed by a main body section 10.

When the main body section 10 is turned ON by the operation of the power switch, the CPU 11 performs the main body processing shown in FIG. 4 and proceeds to Step SB1. At Step SB1, the CPU 11 receives and demodulates acceleration data (including identification data) wirelessly transmitted from the stick section 20-1 and the stick section 20-2, and stores the acceleration data in a predetermined area of the RAM 13.

Next, at Step SB2, the CPU 11 performs note-ON processing for designating a sound to be produced, based on the acquired acceleration data. In the note-ON processing, the CPU 11 judges whether or not a polarity change from positive to negative has occurred between the polarity of acceleration data acquired the last time and the polarity of the acceleration data acquired this time, or in other words, whether or not a note-ON operation has been performed in which the stick section 20 is swung upwards after being swung downwards. When judged that the note-ON operation has been performed, the CPU 11 generates a note-ON event and supplies it to the sound source section 17.

Figure 5:
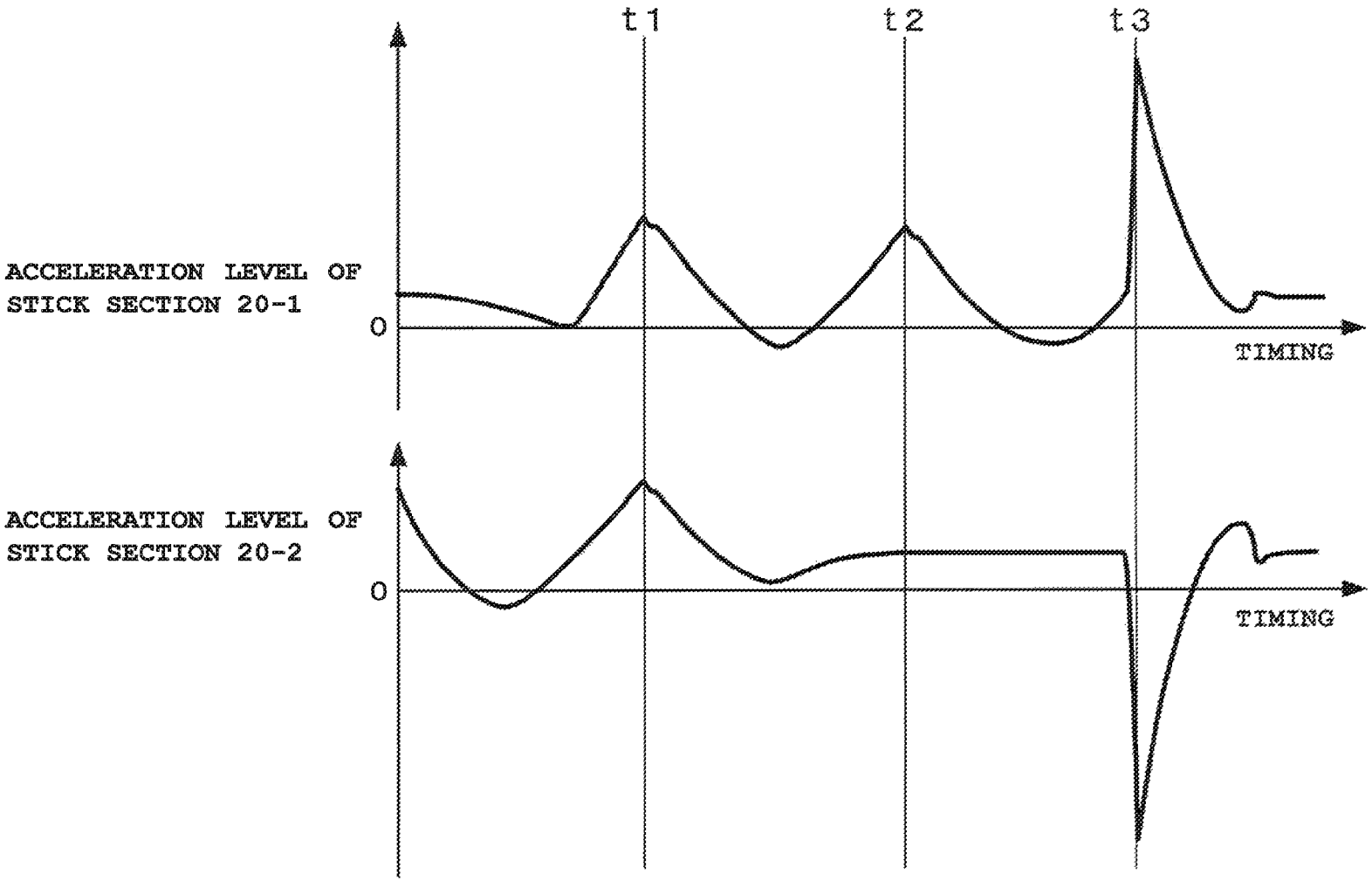
FIG. 5 is a diagram for explaining the operation of the main body processing.

For example, when a note-ON operation is performed in which the stick sections 20-1 and 20-2 are both swung upwards after being swung downwards as indicated by timing t1 shown in FIG. 5, the CPU 11 generates a note-ON event including acceleration data of the stick section 20-1 which has been acquired this time and a note-ON event including acceleration data of the stick section 20-2 which has also been acquired this time, and supplies both note-ON events to the sound source section 17.

As a result, a musical sound associated with the stick section 20-1 (such as a snare drum sound) is produced at a volume corresponding to the level of the acceleration data of the stick section 20-1, and a musical sound associated with the stick section 20-2 (such as a cymbal sound) is produced at a volume corresponding to the level of the acceleration data of the stick section 20-2. Also, when a note-ON operation is performed in which only the stick section 20-1 is swung upwards after being swung downwards as indicated by timing t2 shown in FIG. 5, only a musical sound associated with the stick section 20-1 (such as a snare drum sound) is produced at a volume corresponding to the level of the acceleration data.

Next, at Step SB3, the CPU 11 calculates the most recent moving average of each stick section 20-1 and 20-2 using acceleration data of a plurality of previous samples including the acceleration data acquired this time which have been stored in the predetermined area of the RAM 13, and extracts gravitational force directions relative to the stick sections 20-1 and 20-2, respectively, based on the calculated moving averages of the stick sections 20-1 and 20-2. These gravitational force directions extracted for each stick section 20-1 and 20-2 are temporarily stored in the RAM 13. Next, at Step SB4, the CPU 11 judges whether or not a sudden change in acceleration has occurred in either one of the stick sections 20-1 and 20-2. When judged that a corresponding change in acceleration has not occurred, the judgment result is "NO", and so the CPU 11 returns to the processing at Step SB1 described above, and acquires acceleration data of both stick sections 20-1 and 20-2.

On the other hand, when judged that a sudden change in acceleration has occurred in either one of the stick sections 20-1 and 20-2, the judgment result at Step SB4 is "YES", and so the CPU 11 proceeds to Step SB5. At Step SB5, the CPU 11 calculates the relationship between the direction of the sudden change in acceleration (a first striking direction) and the gravitational force direction. Next, at Step SB6, the CPU 11 judges whether a sudden change in acceleration has occurred in the other stick section 20-1 or 20-2. When judged that a corresponding change in acceleration has not occurred, the judgment result is "NO", and so the CPU 11 returns to the processing at Step SB1, and acquires acceleration data of both stick sections 20-1 and 20-2. Conversely, when judged that a sudden change in acceleration has occurred in the other stick section 20-1 or 20-2, the judgment result at Step SB6 is "YES", and so the CPU 11 proceeds to Step SB7. At Step SB7, the CPU 11 calculates the relationship between the direction of the sudden change in acceleration (a second striking direction) and the gravitational force direction.

Then, at Step SB8, the CPU 11 judges whether or not the first striking direction relative to the gravitational force direction which has been calculated at Step SB5 and the second striking direction relative to the gravitational force direction which has been calculated at Step SB7 are directions opposing each other. When the first striking direction and the second striking direction relative to the gravitational force direction are both forward directions, the judgment result is "NO" and so the CPU 11 returns to the processing at Step SB1.

Figure 6:
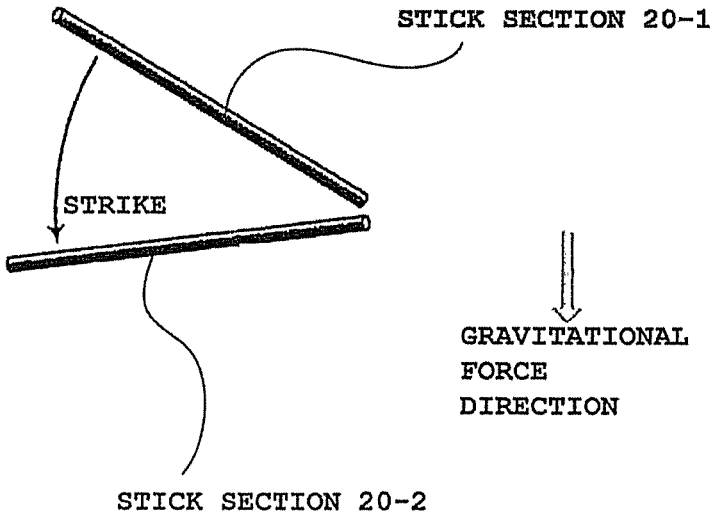
FIG. 6 is a diagram showing an operation in which sticks are struck against one another in a direction substantially parallel to a gravitational force direction.

Conversely, when the first striking direction relative to the gravitational force direction and the second striking direction relative to the gravitational force direction are directions opposing each other as shown by timing t3 in FIG. 5, it is a case where the stick section 20-1 swung in a downward direction parallel ("parallel" here includes "substantially parallel") to the gravitational force direction strikes the stick 20-2, as shown in FIG. 6. When the cross stick technique in which the sticks are struck against one another is performed as just described, the judgment result at Step SB8 is "YES" and so the CPU 11 proceeds to Step SB9.

At Step SB9, the CPU 11 generates a note-ON event instructing to produce a unique sound (striking sound) that is generated when sticks are struck against one another, and supplies the generated note-ON event to the sound source 17. As a result, a striking sound associated with the cross stick technique in which the stick section 20-1 swung downward strikes the stick 20-2 is produced at a volume corresponding to the levels of the acceleration data of both stick sections 20-1 and 20-2.

In the present embodiment, the cross stick technique (first cross stick) in which the stick section 20-1 swung downward strikes the stick section 20-2 is detected, as an example of when a first striking direction relative to the gravitational force direction and the second striking direction relative to the gravitational force direction are directions opposing each other. However, the present invention is not limited thereto. A cross stick technique (second cross stick) in which the stick section 20-2 swung downward strikes the stick section 20-1 can also be detected. When the second cross stick is detected, a note-ON event is generated that instructs to produce a striking sound differing from that of the first cross stick.

After instructing to produce the sound corresponding to the cross stick technique in which the sticks are struck against one another as described above, the CPU 11 proceeds to Step SB10 and judges whether or not an instruction to end the musical performance has been given by the operation of the play switch. When judged that an instruction to end the musical performance has not been given, the judgment result is "NO", and so the CPU 11 returns to the processing at Step SB1. Conversely, when judged that an instruction to end the musical performance has been given, the judgment result is "YES", and so the main body processing is completed.

As described above, in the present embodiment, each stick section 20-1 and 20-2 individually generates and wirelessly transmits acceleration data that changes depending on the stick operation by the user, and the main body section 10 side receives them. Then, the main body section 10 detects whether or not a note-ON operation (in which the stick section 20 is swung upwards after being swung downwards) has been performed, or in other words, whether or not a polarity change from positive to negative has occurred between the polarity of acceleration data acquired the last time and the polarity of the acceleration data acquired this time. When a note-ON operation is detected, note-ON processing is performed that generates a note-ON event including the acceleration data of the stick section 20 with which the note-ON operation has been performed. As a result, a musical sound (such as a snare drum sound) associated with the stick section 20 with which the note-ON operation has been performed is produced at a volume corresponding to the level of the acceleration data.

Then, when the note-ON processing is completed, the most recent moving average of each stick section 20-1 and 20-2 is calculated using acceleration data of a plurality of previous samples including the acceleration data acquired this time, and gravitational force directions relative to the stick sections 20-1 and 20-2 are respectively extracted based on the calculated moving averages. In addition, it is judged whether or not striking movements (sudden change in acceleration) in mutually different directions relative to the extracted gravitational force directions have been simultaneously detected from the stick sections 20-1 and 20-2. That is, whether or not the cross stick technique, in which the sticks are struck against one another, has been performed is judged. Then, when it is judged that the cross stick technique has been performed, an instruction is given to produce the sound of the sticks being struck against one another. Therefore, operation input corresponding to an actual drum performance can be generated.

Figure 7:
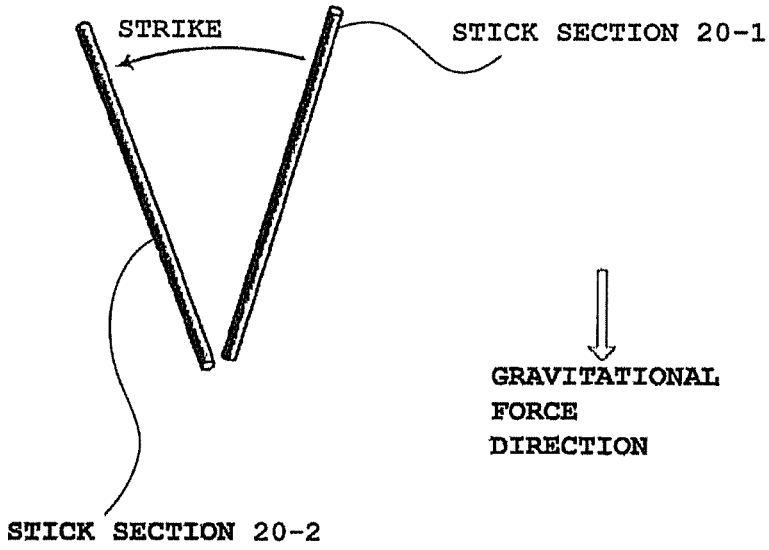
FIG. 7 is a diagram showing an operation in which the sticks are struck against one another in a direction substantially perpendicular to the gravitational force direction, with their tips facing upwards.
Figure 8:
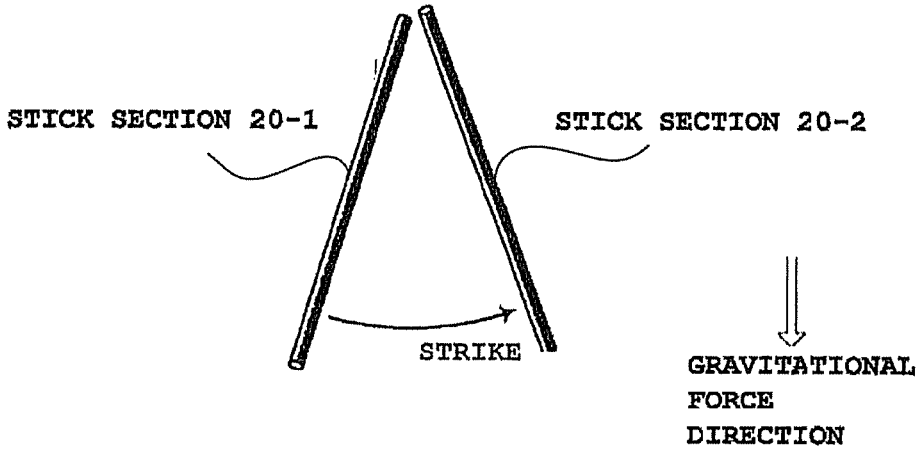
FIG. 8 is a diagram showing an operation in which the sticks are struck against one another in the direction substantially perpendicular to the gravitational force direction, with their tips facing downwards.

In the configuration of the above-described embodiment, the cross stick technique (the first cross stick) in which the stick section 20-1 swung downward strikes the stick section 20-2, or the cross stick technique (the second cross stick) in which the stick section 20-2 swung downward strikes the stick section 20-1 is detected, as an example of when a first striking direction relative to the gravitational force direction and the second striking direction relative to the gravitational force direction are directions opposing each other. However, in addition, whether or not striking in the direction perpendicular ("perpendicular" herein includes "substantially perpendicular") to the gravitational force direction has simultaneously occurred in both stick sections 20-1 and 20-2 may also be detected. In this configuration, for example, a cross stick technique when both stick sections 20-1 and 20-2 are gripped facing upwards is detected in which the stick section 20-1 strikes the stick section 20-2 (third cross stick) or the stick section 20-2 strikes the stick section 20-1 (fourth cross stick), as shown in FIG. 7. In addition, a cross stick technique when both stick sections 20-1 and 20-2 are gripped facing downwards is detected in which the stick section 20-1 strikes the stick section 20-2 (fifth cross stick) or the stick section 20-2 strikes the stick section 20-1 (sixth cross stick), as shown in FIG. 8. As a result, an instruction to produce a striking sound according to a detected type of cross stick technique (the first to sixth cross sticks) can be given.

Moreover, instead of an instruction to produce a striking sound according to a detected type of cross stick technique (the first to sixth cross sticks) being given, the tone of a musical sound to be produced may be selected in the note-ON processing. In addition, the type of an effect to be applied and the like may be selected, whereby the setting of various playing parameters can be performed with the stick sections 20-1 and 20-2 being gripped in both hands. Also, in the above-described embodiment, the main body section 10 and the stick sections 20-1 and 20-2 are connected wirelessly. However, the main body section 10 and the stick sections 20-1 and 20-2 may be connected by wires.

While the present invention has been described with reference to the preferred embodiments, it is intended that the invention be not limited by any of the details of the description therein but includes all the embodiments which fall within the scope of the appended claims.

What is claimed is:

1. An input device comprising:

a first operation detecting section which is provided on one stick and detects acceleration based on movement of the one stick;

a second operation detecting section which is provided on an other stick and detects acceleration based on movement of the other stick;

a note-ON operation judging section which judges a note-ON operation in which each of the one stick and the other stick a swung upwards after being swung downwards when detected that a polarity change from positive to negative has occurred between polarity of acceleration data acquired last time and polarity of the acceleration data acquired this time from the each of the first operation detecting section and the second operation detecting section;

a first instructing section which instructs to produce a sound associated with the each of the one stick and the other stick, when the note-ON operation judging section judges the note-ON operation;

a first strike judging section which judges that the one stick and the other stick have struck against one another, when detected that sudden acceleration changes in mutually different directions occur in the first operation detecting section and the second operation detecting section simultaneously; and a second instructing section which instructs to produce a sound corresponding to striking of the one stick and the other stick against one another and differing from the sound that the first instructing section instructs to produce, when the first strike judging section judges that the one stick and the other stick have struck against one another.

2. The input device according to claim 1, wherein the first strike judging section judges that the one stick and the other stick have struck against one another, when sudden acceleration changes in a direction substantially parallel with a gravitational force direction occur in the one stick and the other stick simultaneously.

3. The input device according to claim 1, wherein the first strike judging section judges that the one stick and the other stick have struck against one another, when sudden acceleration changes in a direction substantially perpendicular to a gravitational force direction occur in the one stick and the other stick simultaneously.

4. The input device according to claim 1, further comprising:

a second strike judging section which judges which of the one stick and the other stick has swung downwards for the one stick and the other stick to be struck against one another, based on the acceleration detected by the first operation detecting section and the acceleration detected by the second operation detecting section;

wherein the second instructing section instructs to produce a sound corresponding to striking of the one stick and the other stick against one another which has been judged by the second strike judging section.

5. The input device according to claim 1, further comprising:

a calculating section which calculates moving averages from the acceleration detected by the first operation detecting section and the acceleration detected by the second operation detecting section; and an identifying section which identifies gravitational force directions relative to the one stick and the other stick, based on the moving averages calculated by the calculating section.

6. A non-transitory computer-readable storage medium having stored thereon a program that is executable by a computer, the program being executable by the computer to perform functions comprising:

a first operation detection processing for detecting acceleration based on movement of one stick;

a second operation detection processing for detecting acceleration based on movement of an other stick;

a note-ON operation judging processing which judges a note-ON operation in which each of the one stick and the other stick is swung upwards after being swung downwards when detected that a polarity change from positive to negative has occurred between polarity of acceleration data acquired last time and polarity of the acceleration data acquired this time from the each of the first operation detecting processing and the second operation detecting processing;

a first instructing processing which instructs to produce a sound associated with the each of the one stick and the other stick, when the note-ON operation judging processing judges the note-ON operation;

a strike judgment processing for judging that the one stick and the other stick have struck against one another, when detected that sudden acceleration changes in mutually different directions occur in the first operation detecting processing and the second operation detecting processing simultaneously; and a second instruction processing for instructing to produce a sound corresponding to striking of the one stick and the other stick against one another and differing from the sound that the first instructing processing instructs to produce, when the one stick and the other stick are judged to have struck against one another by the strike judgment processing.

* * * * *